United States Patent [19]

Barelli et al.

[11] Patent Number: 4,729,454

[45] Date of Patent: Mar. 8, 1988

[54] SELF-BRAKING SAFETY APPARATUS FOR THE RAPID DESCENT OF PERSONS IN CASES OF EMERGENCY

[76] Inventors: Piero Barelli, Via Cantonale 46, 6963 Pregassona; Arnaldo Simoncelli, Via Pelloni 5, 6900 Lugano; Maruillo Roda, Via Crocetta 25, 6962 Viganello; Fabrizio Guarisco, 6911 Manno, all of Switzerland

[21] Appl. No.: 49,513

[22] Filed: May 14, 1987

[30] Foreign Application Priority Data

May 14, 1986 [CH] Switzerland ..... 01955/86

[51] Int. Cl.[4] ..... A62B 1/10

[52] U.S. Cl. ..... 182/234; 182/235; 182/239; 182/240; 188/65.3

[58] Field of Search ..... 182/5, 6, 7, 231, 234, 182/235, 75, 239, 240; 188/65.3, 65.1

[56] References Cited

U.S. PATENT DOCUMENTS

| | | | |
|---|---|---|---|
| 522,990 | 7/1894 | Kopp | 182/240 |
| 2,122,315 | 6/1938 | Fosty | 182/239 |
| 2,205,026 | 6/1940 | Barham | 182/235 |
| 2,518,934 | 8/1950 | Renner | 182/234 |
| 2,561,832 | 7/1951 | Wilson | 182/235 |
| 4,063,615 | 12/1977 | Knepp | 182/5 |
| 4,359,139 | 11/1982 | Bloder | 182/234 |
| 4,457,400 | 7/1984 | Donaldson | 182/234 |
| 4,487,292 | 12/1984 | Smith | 182/234 |

*Primary Examiner*—Reinaldo P. Machado

*Attorney, Agent, or Firm*—Birch, Stewart, Kolasch, & Birch

[57] ABSTRACT

A self-braking apparatus is provided for cases of emergency in which a rapid descent of persons threatened by fire or danger is required on the outside of buildings or the like. The apparatus can be secured to a fixed point from which the descent is to be made and comprises a rotor on which a rope is wound which is mounted coaxially and inwardly of a drum. A heat-resistant handle and a brake which can be actuated by the user are secured to the drum by brackets. The rotor is provided with a plurality of radial holes each containing a spring urging a brake pad outwardly against the inner surface of the drum. The brake which can be actuated by the user is formed by a pair of levers pivotally connected to each other and acting with one of their ends on rods having an inclined plane in turn acting on brake pads urged against the lateral surface of the drum by the rods. When the hand brake is released, the rotation of the rotor and centrifugal force generated thereby exert braking action against the inner surface of the drum to produce a constant speed of descent of about 2.5 m/sec.

4 Claims, 8 Drawing Figures

SELF-BRAKING SAFETY APPARATUS FOR THE RAPID DESCENT OF PERSONS IN CASES OF EMERGENCY

BACKGROUND OF THE INVENTION

This invention relates to a self-braking safety apparatus adapted to permit the rapid descent of persons on the outside of buildings or the like in cases of emergency, and more particularly a descent of the "double rope" type in mountaineering.

It is known that unfortunately it is often necessary to evacuate rooms in high buildings on fire where any way of exit from the flames or smoke, which makes the air irrespirable, is impossible.

Other cases in which it is necessary to evacuate persons by extraordinary means, i.e. from windows or balconies, occur in cases of earthquakes or other seizmic calamities.

It is evident that in the following specification, unless otherwise specified, an "extraordinary descent" is intended to mean a descent by other than the normal ways of access and/or exit, i.e. a descent on the outside of the building.

Still other cases in which an extraordinary descent may become necessary are:

The descent from inaccessible places such as ravines, crevasses, wells, bridges;

The evacuation from sinking ships;

The simultaneous descent of several persons from helicopters.

Various devices are known for the rapid evacuation of persons from buildings in cases of emergency: in general, they are emergency winches or capstans, generally devised for this purpose, but just because they are extraordinary and little used, or at least intended to be little used, they are of rather a rudimental nature.

On the other hand, it is an object of the present invention to provide an "ad hoc" apparatus designed and constructed for the precise purpose of permitting a rapid evacuation of the persons from the dangerous place in which they are, whereby said rapid evacuation or descent of the "double rope" type commonly used in mountaineering is made necessary.

It is to be noted that the present apparatus is completely mechanical, does not require any maintenance, can be easily used by any person and is of very light weight.

It is evident that the present apparatus for its use be suspended from a hook or some support fixed to the window, balcony or place from wich one has to descend.

SUMMARY OF THE INVENTION

The present invention is substantially constituted by:

a substantially I-shaped or reel-shaped rotor on the core of which a rope is wound, one end of said rope being secured to the rotor and the other end being free and provided with an appropriate spring catch for hooking to a fixed support;

a coaxial fixed drum containing said rotor;

characterized in that the rotor carries on its outside portions or flanges a series of equidistant radial holes and a series of likewise equidistant lightening apertures, each of said radial holes containing a ball and resilient means urging the ball outwardly, appropriate brake pads being provided downstream of each of said balls and being urged against the inner surface of the drum in which the rotor is mounted, said brake pads having the same curvature as the inner surface of the drum against which they are supported, two brackets being provided outwardly of the drum and being firmly secured thereto and leading to a heat-resistant handle adapted to be gripped by the user, a pair of pivotally connected levers being firmly secured to said heat-resistant handle and to said brackets, said pair of levers being pivotally connected to each other along the longitudinal center line of the handle and at the other end to two rods, one for each bracket, said rods being movable longitudinally relative to said brackets and being provided at the end remote from the handle with two inclined planes , one for each rod, adapted to control on actuation of the levers two brake pads acting laterally relative to the direction of movement of the rods, said brake pads acting laterally against the lateral surface of the drum on actuation of said levers constituting the hand brake to permit the user to stop at the desired point during his descent, the brake pads provided between the rotor and the drum, when the user descends at free speed without actuating the hand brake, being urged by centrifugal force with ever increasing intensity against the drum to increase the braking action already exerted by the springs and ensure a maximum speed of descent being achieved that is absolutely supportable and by no means dangerous to the user of the apparatus, said speed being about 2.5 m/sec. which corresponds to the speed that can be obtained by jumping freely to the earth from a height of about 1 meter.

Another fundamental characteristic of the present invention consists in that the rope wound around the central portion of the rotor is secured thereto by means of an annular clamp locked in its seat by normal screw means, said clamp which is accommodated in a recess having a beveled inner angle (of about 30°) to thus urge the rope against the radius of the seat and lock it.

A further fundamental characteristic of the present invention consists in that said self-braking apparatus, which can be used for children, elderly or any other persons and which is provided with means for securing it to a fixed support such as a hook or the like in the place from which one has to descend, is equipped with appropriate means to which a means of transport of the user or users can be attached.

Still a further fundamental characteristic of the present invention consists in that the means of transport secured to the apparatus is a harness provided with safety belts and buckles for adjusting the length of said belts, said harness being adapted to receive therein one or more persons according to the selected type of harness.

DESCRIPTION OF PREFERRED EMBODIMENT

Figure 1:
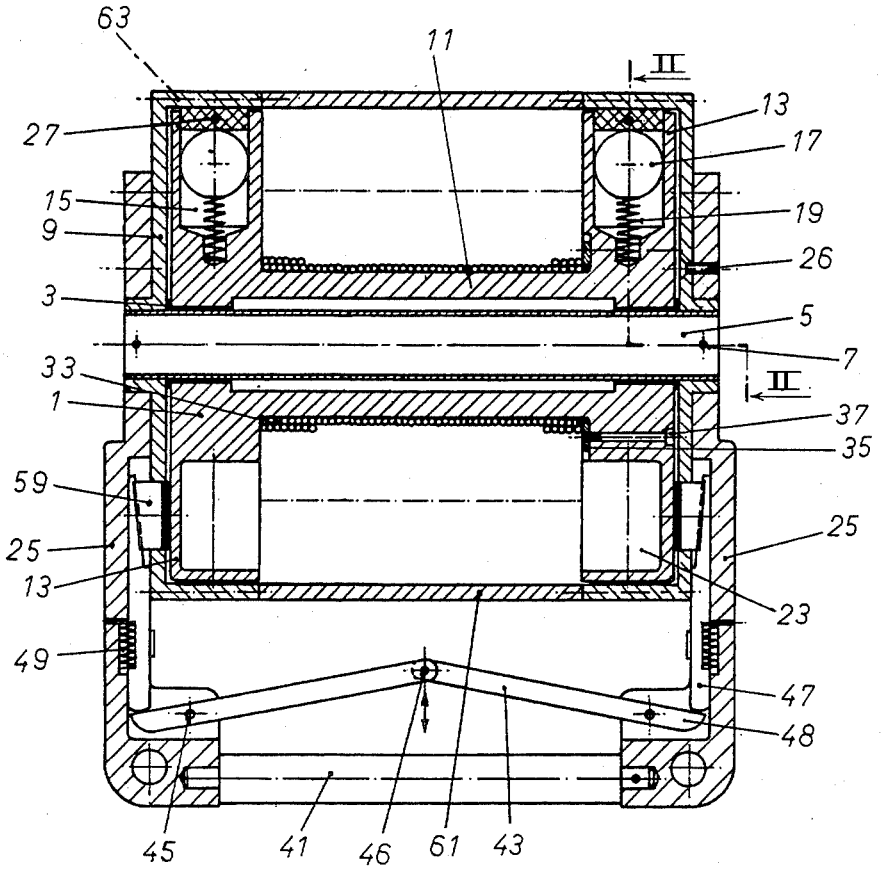
FIG. 1 is a longitudinal axial section through a rotor, drum and brackets forming the essential elements of the apparatus according to the present invention.

As shown in the drawings, particularly FIG. 1, the present apparatus substantially comprises a rotor 1 which in the illustrated embodiment is made of a light alloy and is centrally mounted for rotation on bushes 3 made of graphitic steel and in turn centered on a central sleeve 5 of steel. The sleeve 5 is secured by appropriate resilient pins 7 to an outer drum 9 which will be described hereinafter.

As shown in FIG. 1, the rotor is substantially I-shaped in longitudinal axial section and comprises a central body 11 and a pair of flanges 13 or portions of larger diameter.

Figure 2:
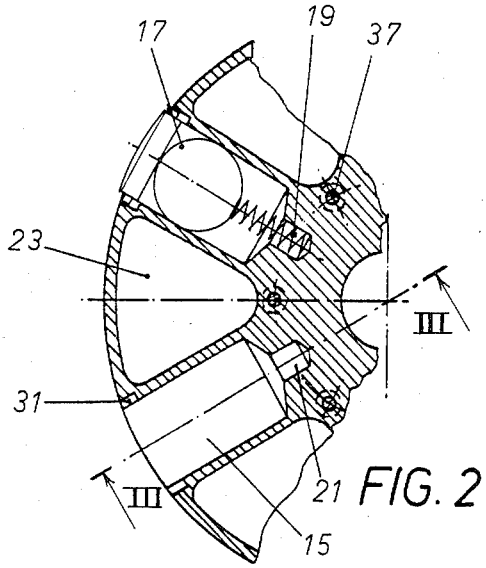
FIG. 2 is a partial section taken along the line II—II in FIG. 1.

Twelve radial holes 15 are provided in each of the flanges or portions 13 and each accommodate a precision ball 17 urged outwardly by an appropriate helical spring 19 each centered in a hole 21 as shown in FIG. 2.

Lightening apertures 23 are provided in the spaces between the holes 15 in equal numbers in each of the flanges 13.

The drum 9 has a substantially cylindrical shape and is mounted on the rotor 1 outwardly thereof. The drum 9 forms a single body with brackets 25 which are secured thereto at 26 and will be described hereinafter.

In each of the radial holes 15, the helical springs 19 and consequently the balls 17 constantly urge against respective brake pads 27 which in turn urge against the inner surface of the drum 9.

Figure 5:
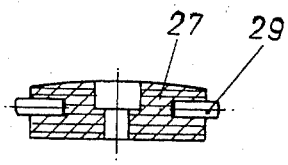
FIG. 5 is a longitudinal section illustrating the shape of the brake pads inserted in the rotor.
Figure 6:
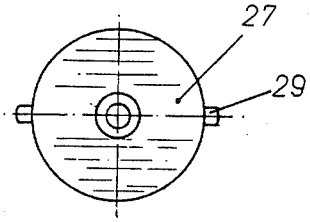
FIG. 6 is a plan view of FIG. 5.
Figure 3:
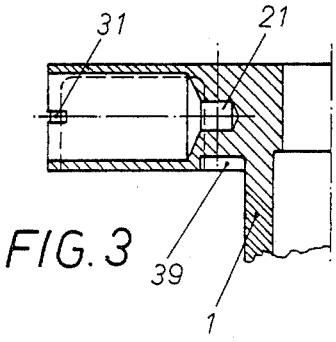
FIG. 3 is a partial section taken along the line III—III in FIG. 2.

Evidently the brake pads 27 have the same curvature as the drum 9 and they have a pair of small pins 29 as shown in FIG. 5 to keep them in an ideal position by sliding in recesses 31 (FIG. 2).

As shown in FIG. 1, the fixed drum 9 is also centered on the central sleeve 5, thus permitting a perfect alignment with the axis of the rotor 1.

Figure 4:
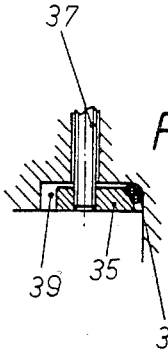
FIG. 4 is an enlarged partial section illustrating a system of fixing the rope to the rotor.

A rope 33 is wound on the central body of core 11 of the rotor 1 and is secured with its inner end to an annular clamp 35 which is locked in position by six screws 37. As shown in FIG. 4, the clamp 35 is accommodated in a recess 39 and has an inner corner beveled at 30° to thus urge the rope against the radius of the seat and lock it.

The aforementioned brackets 25 are made of a hardened light alloy and support a heat-resistant handle 41 as well as levers 43 of a hand brake.

As shown in FIG. 1, the levers 43 are pivotally mounted on the brackets 25 by cylindrical pins 45 and are pivotally connected to each other at one end 46 whereas with the other end 48 they actuate rods 47 which under the action of springs 49 automatically return to the initial position as soon as the manual action on the levers 43 is released.

Figure 7:
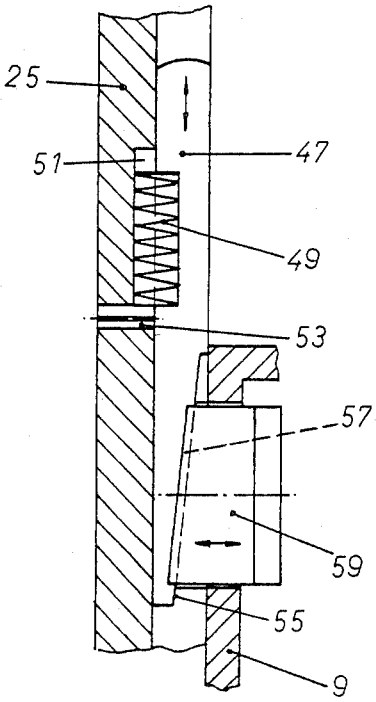
FIG. 7 is a sectional detail view illustrating the hand brake.

As shown in FIG. 7, the springs 49 are accommodated in seats 51 milled into the brackets 25 and with one end abut against a resilient pin 53 and with the other against a shoulder wall of the seats 51 milled into the rods 47.

The rods 47 are placed laterally of the drum 9 and have an inclined plane 55 at one end, this plane having an inclination in the order of 8° and being arranged to slide in a recess 57 of a locking pad 59, this recess also preventing the locking pad 59 from rotating.

The locking pads 59 pass through the hole in the drum 9 and as they are actuated by means of the levers 49 by a slight manual effort due to the large lever ratio, they lock the rotor 1 at once at the desired moment.

Four equidistant spacers 61 are secured by means of screws 63 to the drum 9 as shown in FIG. 1.

Figure 8:
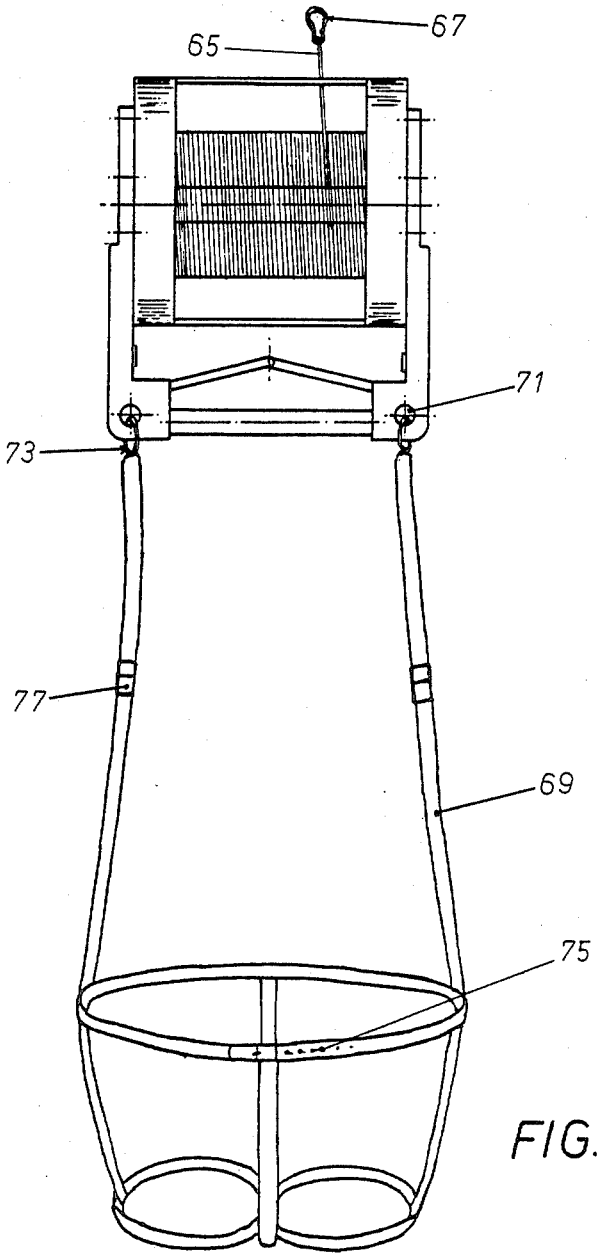
FIG. 8 is a front view of the present apparatus to which a harness has been applied.

As shown in FIG. 8, a safety spring catch 67 is secured to the free end 65 of the rope and will be fixed to a hook prearranged in the vicinity of the place from which the descent is to be made.

FIG. 8 also shows, by way of an illustrative example, a harness 69 adapted to receive the person who has to descend. This harness is adjustable and will be hooked into holes 71 in the brackets 25 by means of quick-set spring catches 73.

Also an adjustable belt 75 and appropriate buckles 77 are provided for adjusting the length thereof.

The operation of the present apparatus will now be briefly described to clarify the various functions of the members described above and to permit a better understanding of the essential features of the present invention.

When the user begins his descent into the empty space below, he will hold tight the handle 41 and simultaneously actuate the hand brake 43 which he will then slowly release until the maximum speed has been reached.

At this point the balls of the rotor will be pushed outwardly due to the effect of the rotation and the centrifugal force generated thereby and will exert an ever increasing pressure on the brake pads 27 which at this point will automatically slow down the speed of rotation of the rotor by exerting friction on the wall of the fixed drum 9.

The rotor will be stabilized at a speed of rotation corresponding to a descent of 2.5 m/sec. which corresponds to an impact on the ground as if one would jump from a height of about one meter.

Although a preferred embodiment of the invention has thus been described in detail and illustrated in the accompanying drawings, it is to be understood that the invention is not limited to this precise embodiment and that numerous changes and modifications obvious to one skilled in the art may be made therein without departing from the scope of the invention as defined by the appended claims.

We claim:

1. In a self-braking safety apparatus for the rapid descent of persons in cases of emergency, comprising a reelshaped rotor having a core and a rope wound on the core, one end of said rope being secured to said rotor and the other end being free and provided with an appropriate spring catch for hooking to a fixed support in the vicinity of the place from which the descent is to be made, and a coaxial fixed drum containing said rotor, the improvement comprising:

said reel-shaped rotor having end flanges projecting from said core and provided with a series of equidistant radial holes and with a series of equidistant lightening apertures between said holes, each of said radial holes containing a ball and a spring urging said ball outwardly;

brake pads arranged downstream of each of said balls and urged by said springs against an inner surface of said drum, said brake pads having the same curvature as said inner surface of said drum;

a pair of brackets arranged outwardly of said drum and firmly secured thereto and leading to a heat-resistant handle adapted to be gripped by the user;

a pair of pivotally connected levers firmly secured to said heat-resistant handle and to said brackets, said pair of levers being pivotally connected to each other along a longitudinal center line of said handle and at the other end to a pair of rods, one for each bracket, said rods being movable longitudinally relative to said brackets and being provided at the end remote from said handle with a pair of inclined planes, one for each rod;

a pair of brake pads adapted to be controlled by said inclined planes on actuation of said levers to act laterally relative to the direction of movement of the drum against a lateral surface of said drum, said brake pads thus constituting a hand brake permitting the user to stop at the desired position during his descent, said brake pads provided between said rotor and said drum, when the user descends at free speed without actuating said hand brake, being urged be centrifugal force with ever increasing intensity against said drum to increase the braking action exerted by said springs and ensure that a maximum speed of descent is achieved that is absolutely safe for the user of the apparatus.

2. A self-braking safety apparatus as claimed in claim 1, wherein said rope wound on said core of said rotor is secured thereto by means of an annular clamp locked in position by screw means, said clamp being accommodated in a recess in said core and having a beveled inner corner for urging said rope against the radius of said recess and lock it.

3. A self-braking safety apparatus as claimed in claim 1, wherein said rope is provided at its free end with means for securing it to a fixed support such as a hook in the place from which the descent is to be made, and said apparatus is further provided with means for the attachment of a means of transport for the user.

4. A self-braking safety apparatus as claimed in claim 3, wherein said means of transport is a harness provided with at least one safety belt and buckles for adjusting the length of said belt, said harness being adapted to receive therein at least one person.

* * * * *